US010655861B2

(12) United States Patent
Chen

(10) Patent No.: US 10,655,861 B2
(45) Date of Patent: May 19, 2020

(54) SAFE COMBUSTION DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 366 days.

(21) Appl. No.: 15/702,932

(22) Filed: Sep. 13, 2017

(65) Prior Publication Data

US 2019/0078791 A1 Mar. 14, 2019

(51) Int. Cl.

| | |
|---|---|
| ***F24C 5/04*** | (2006.01) |
| ***F23D 3/26*** | (2006.01) |
| ***F23D 3/24*** | (2006.01) |
| ***F23D 3/08*** | (2006.01) |

(52) U.S. Cl.

CPC ..... *F24C 5/04* (2013.01); *F23D 3/08* (2013.01); *F23D 3/24* (2013.01); *F23D 3/26* (2013.01)

(58) Field of Classification Search

CPC ..... F24C 3/08; F24C 3/24; F24C 3/26; F24C 5/04; F24C 5/06

USPC ..... 431/319, 298, 320, 331–342, 322; 126/96

See application file for complete search history.

(56) References Cited

U.S. PATENT DOCUMENTS

| | | | | |
|---|---|---|---|---|
| 3,343,586 | A * | 9/1967 | Berchtold | F23D 91/02 431/241 |
| 4,834,064 | A * | 5/1989 | Takashima | F24C 1/14 126/512 |
| 9,512,998 | B2 | 12/2016 | Masterson et al. | |
| 9,651,246 | B2 | 5/2017 | Chen | |
| 9,816,701 | B2 | 11/2017 | Chen | |
| 9,951,953 | B2 | 4/2018 | Hansen | |
| 2007/0111149 | A1 | 5/2007 | Matsuyama | |
| 2016/0061456 | A1 | 3/2016 | Jang | |
| 2017/0009998 | A1 | 1/2017 | Yeh et al. | |

FOREIGN PATENT DOCUMENTS

| | | | |
|---|---|---|---|
| CN | 201416914 | Y | 3/2010 |
| CN | 202153026 | U | 2/2012 |
| CN | 104342290 | A | 2/2015 |
| EP | 2660510 | A1 | 6/2013 |

* cited by examiner

*Primary Examiner* — Vivek K Shirsat

(74) *Attorney, Agent, or Firm* — Alan D. Kamrath; Karin L. Williams; Mayer & Williams PC

(57) ABSTRACT

A safe combustion device includes a stove body including a fuel reservoir, a fuel tray disposed vertically above and separately from the fuel reservoir and defining an air flow passage, and a wick with an upper end connected to the fuel tray and disposed in the air flow passage and a lower end disposed in a reservoir space defined by the fuel reservoir respectively.

12 Claims, 5 Drawing Sheets

SAFE COMBUSTION DEVICE

BACKGROUND OF THE INVENTION

1. Field of the Invention

The present invention relates to a safe combustion device and, particularly, to a safe combustion device designed to be safer.

2. Description of the Related Art

U.S. Pat. No. 9,651,246 shows a combustion device which can induce and guide air flows in a manner to produce a stable flame and cool the device effectively. The greater the flame size, the more thermal energy is output, but the hotter a fuel tank of the combustion device will become. If the temperature of the fuel tank exceeds the flash point of the fuel, it is dangerous. The flame will heat surrounding air. Thus, heated air will move up and cool air will move down through convection. Some heat will transfer to structures of the combustion device that are disposed in the vicinity of and underneath the flame through radiation and conduction.

When intending to produce a large flame, or when the flame burns for a long period of time, such combustion device still does not prevent heat insulation efficiently and suffer a problem in that the temperature of the fuel tank gets hot and exceeds the flash point of the fuel received by the fuel tank. In addition, enlarging the fuel tank still does not solve the problem in that the fuel tank cannot be maintained at a low, safe temperature after the flame burns for a long period.

The present invention is, therefore, intended to obviate or at least alleviate the problems encountered in the prior art.

SUMMARY OF THE INVENTION

According to the present invention, a safe combustion device includes a stove body including a fuel reservoir, a fuel tray disposed vertically above and separately from the fuel reservoir and defining an air flow passage, and a wick with an upper end connected to the fuel tray and disposed in the air flow passage and a lower end disposed in a reservoir space defined by the fuel reservoir respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a safe combustion device that keeps a fuel tank thereof at a low safe temperature during use.

Other objectives, advantages, and new features of the present invention will become apparent from the following detailed description of the invention when considered in conjunction with the accompanied drawings.

DETAILED DESCRIPTION OF THE INVENTION

Figure 1:
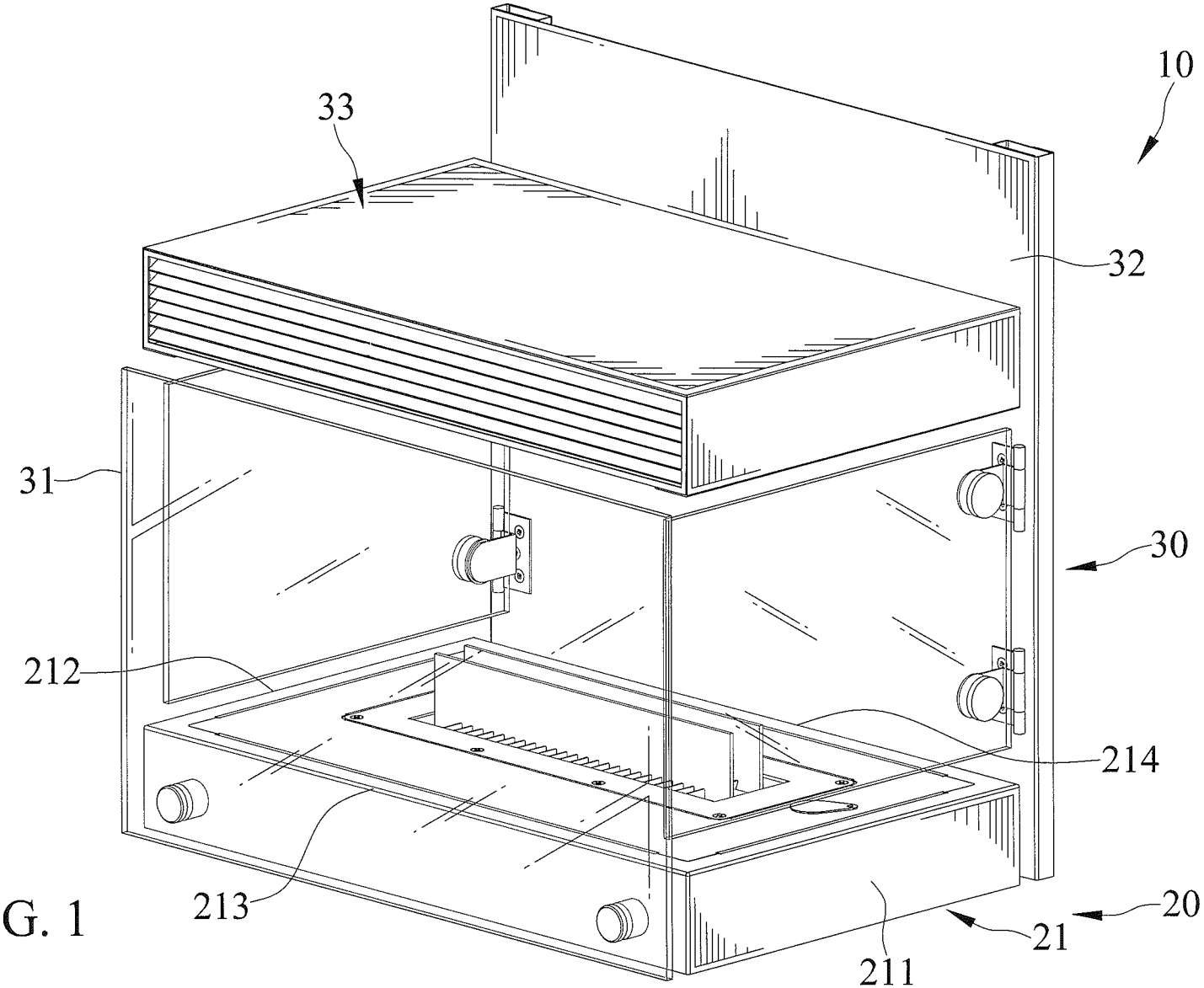
FIG. 1 is a perspective view of a safe combustion device in accordance with the present invention.
Figure 2:
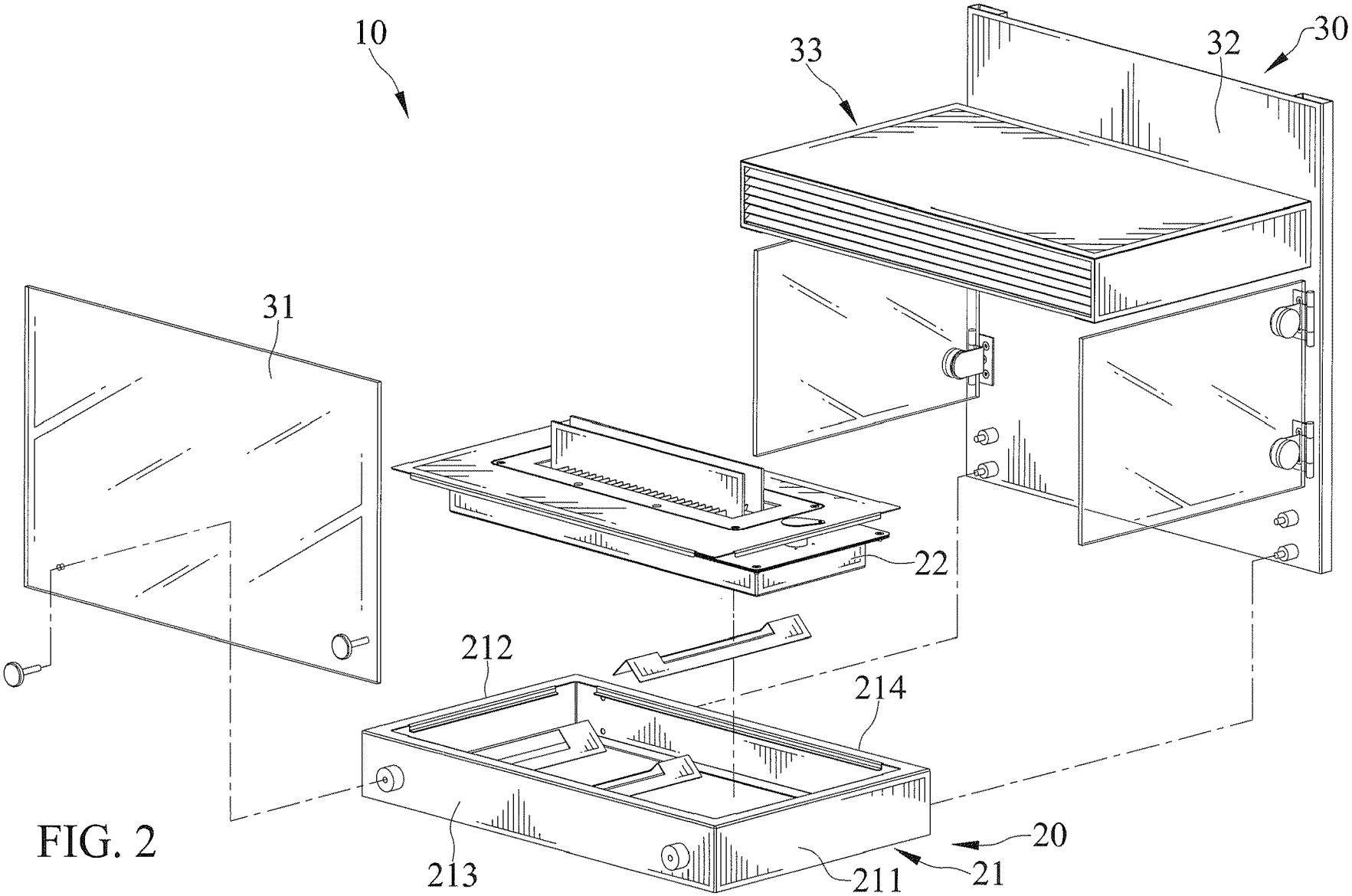
FIG. 2 is an exploded perspective view of the safe combustion device of FIG. 1.
Figure 3:
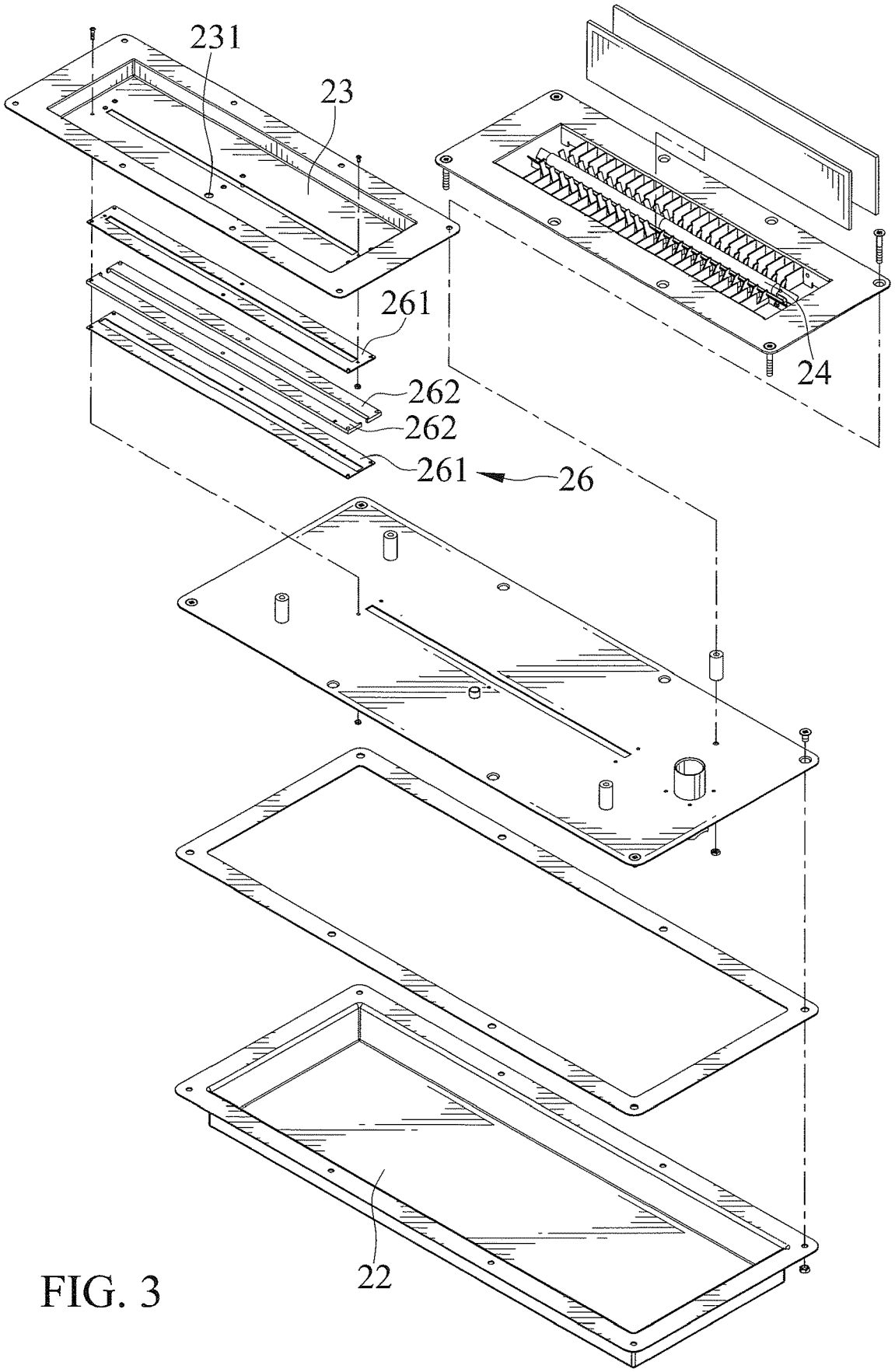
FIG. 3 is a partial, exploded perspective view of the safe combustion device of FIG. 1.
Figure 4:
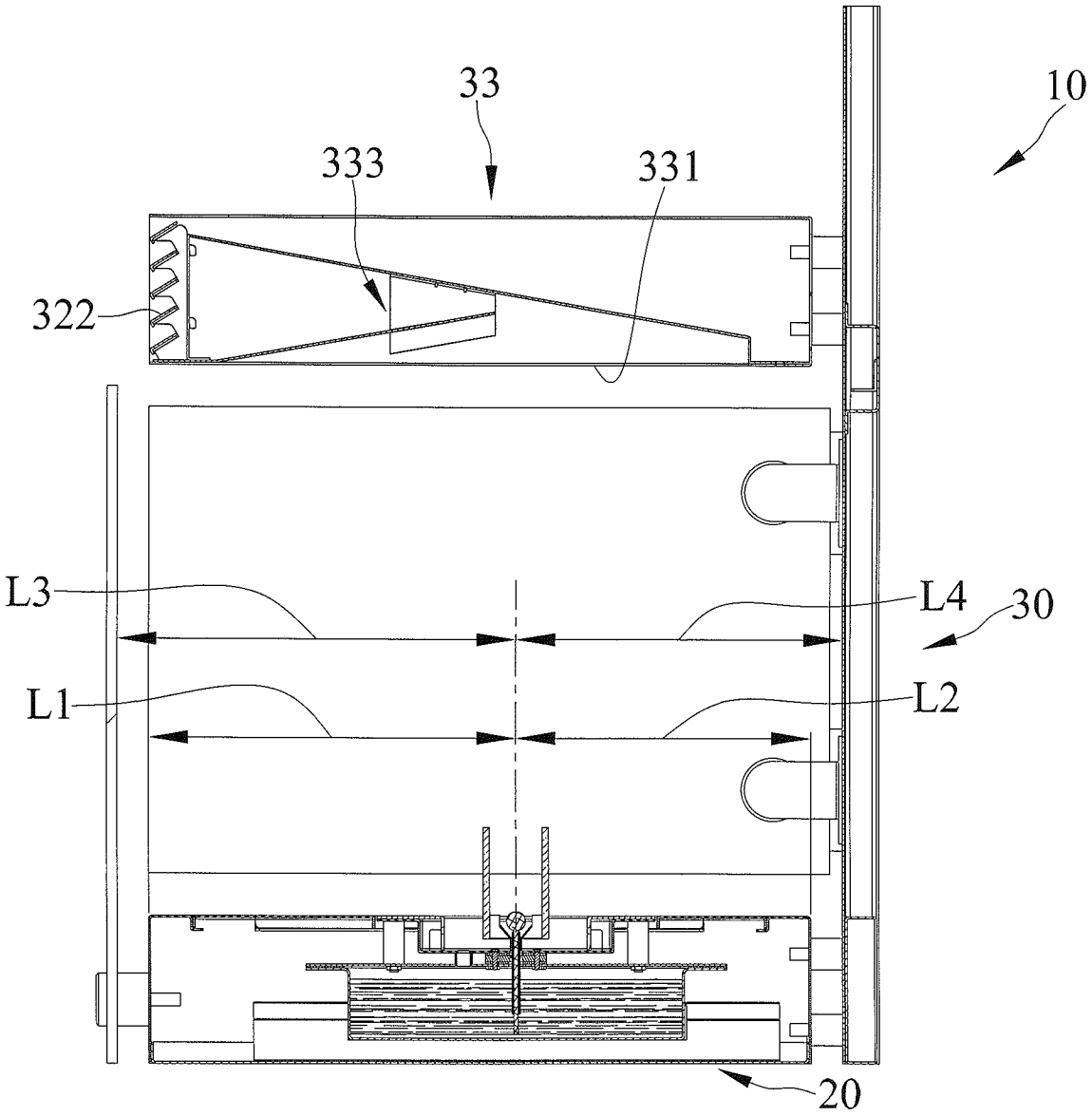
FIG. 4 is a cross-sectional view of the safe combustion device of FIG. 1.
Figure 5:
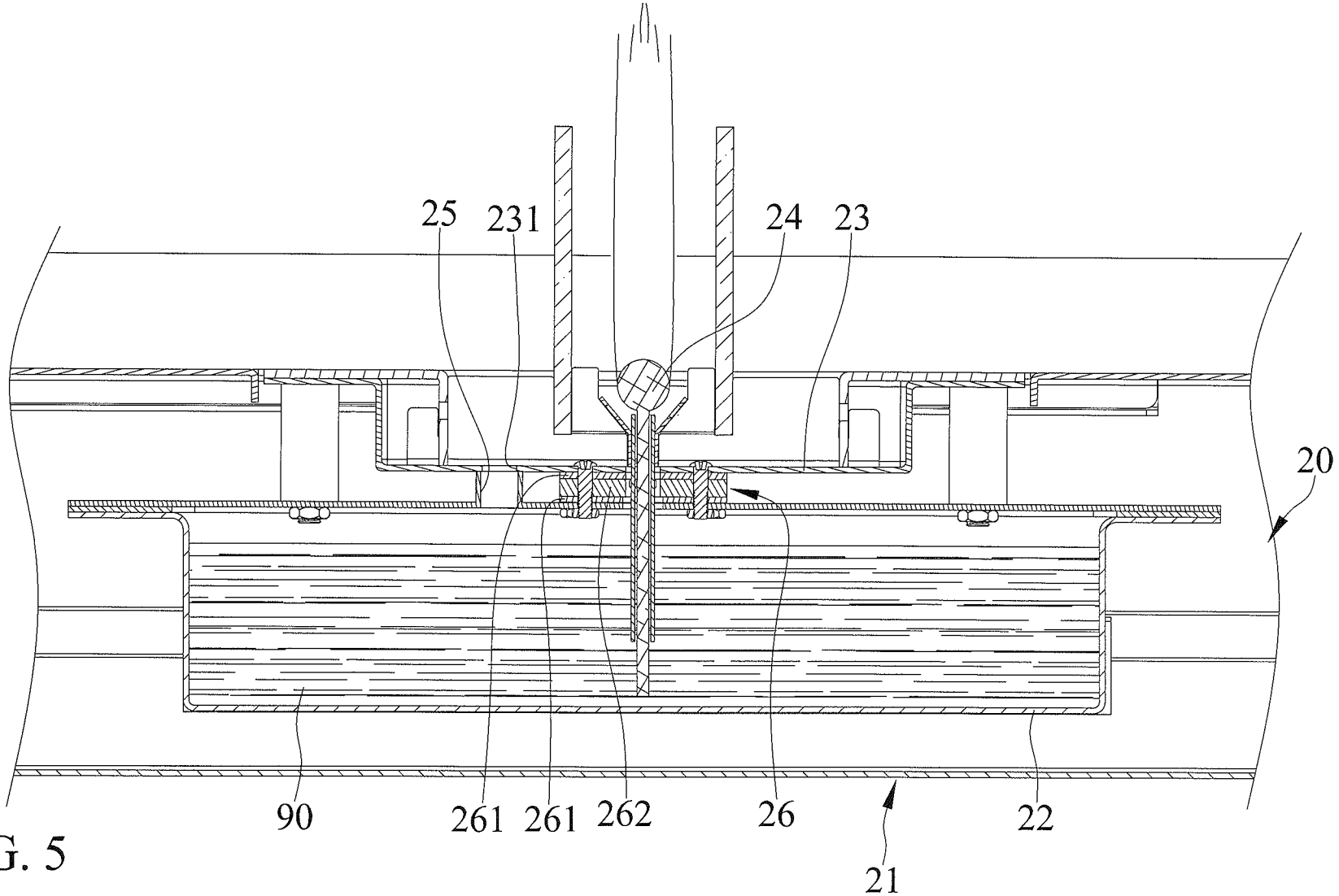
FIG. 5 is a cross-sectional view showing the safe combustion device of FIG. 1 in use.

FIGS. 1 through 4 show a safe combustion device 10 in accordance with the present invention. The safe combustion device 10 includes a stove body 20 including an outer container 21, a fuel reservoir 22, a fuel tray 23, a wick 24, and a thermal insulating device 26. The safe combustion device 10 also includes a flow guiding device 30.

The outer container 21 defines a cavity. The outer container 21 is in a shape having a first, second, third, and fourth side 211, 212, 213, and 214. The first side 211 is opposite the second side 212. The third side 213 is opposite the fourth side 214. The third and fourth sides 213 and 214 extend between the first and second sides 211 and 212.

The fuel reservoir 22 defines a reservoir space configured for storing fuel 90. The fuel reservoir 22 is disposed in the cavity. The fuel reservoir 22 has outer peripheries spaced from adjacent inner peripheries of the outer container 21.

The fuel tray 23 is disposed vertically above and separately from the fuel reservoir 22 and defines an air flow passage. The fuel tray 23 has a fuel drain hole 231 extending therethrough, and the stove body 20 defines a channel 25 having a first and second end respectively communicating with the fuel drain hole 231 and the reservoir space.

The wick 24 has an upper end connected to the fuel tray 23 and disposed in the air flow passage and a lower end disposed in the reservoir space respectively. The wick 24 has a height extending from the upper end to the lower end. The wick 24 has a greater width at the upper end than the lower end.

The thermal insulating device 26 interconnects the fuel reservoir 22 and the fuel tray 23. The thermal insulating device 26 prevents heat transfer between the heat reservoir 22 and the fuel tray 23. The thermal insulating device 26 has two opposite lateral sides, and the wick 24 extends through the thermal insulating device 26 and is disposed between the two lateral sides.

The thermal insulating device 26 includes two thermal insulating members 261 and a fixture 262 for supporting the thermal insulating members 261 between the fuel reservoir 22 and the fuel tray 23. Each of the two thermal insulating members 261 has two opposite lateral sides, and the wick 24 extends through the two thermal insulating members 261 and is disposed between the two lateral sides thereof. One of the thermal insulating members 261 is abutted against an outer surface of the reservoir 22 and another thermal insulating member 261 is abutted against an outer surface of the fuel tray 23 respectively. The fixture 262 is disposed between the two thermal insulating members 261. The fixture 262 includes at least one fixing plate and at least one fastener. The two fixing plates are made of metal. The fuel reservoir 22, the at least one fixing plate, and the fuel tray 23 respectively include an engaging hole for engaging with the at least one fastener. The at least one fixing plate is disposed between the two thermal insulating members 261, and one of the two thermal insulating members 261 is secured to the fuel reservoir 22 by engaging the at least one fastener with the engaging holes of the fuel reservoir 22 and the at least one fixing plate while another thermal insulating member 261 is secured to the fuel tray 23 by engaging the at least one fastener with the engaging holes of the fuel tray 23 and the at least one fixing plate. The two thermal insulating members 261 and the at least one fixing plate are in a form of a plate and extend parallel to one another. The at least one fixing plate includes two fixing plates. The two fixing plates are disposed adjacent to one another with a space therebetween, and the wick 24 is disposed between the two fixing plates and extends through the space.

Furthermore, the stove body 20 includes two shields disposed parallel to one another. The wick 24 is disposed between and spaced from the two shields. The upper end of the wick 24 has a length extending parallel to the shields. Each of the shields includes a top end positioned outside the fuel tray 23 and a bottom end positioned within and spaced from a bottom side of the fuel tray 23. The upper end of the wick 24 is at a lower height than the top ends of the shields.

The flow guiding device 30 includes a first and second shielding member 31 and 32 respectively disposed adjacent and connected to opposite third and fourth sides 213 and 214 of the outer container 21. The first and second shielding members 31 and 32 are disposed parallel to the two shields. The wick 24 is spaced from the third and fourth sides 213 and 214 at first and second distances L1 and L2 respectively. The wick 24 is spaced from the first and second shielding members 31 and 32 at third and fourth distances L3 and L4 respectively. The third distance L3 is greater than the first distance L1 and the first shielding member 31 is spaced apart from the third side 213. The fourth distance L4 is greater than the second distance L2 and the second shielding member 32 is spaced apart from the fourth side 214. The first and second shielding members 31 and 32 extend vertically and each has a top end at a higher height than the fuel tray 23 and the upper end of the wick 24. The first shielding member 31 is a glass. The second shielding member 32 is a glass, or a mount, or a wall of a room.

The flow guiding device 30 also includes a heat extracting apparatus 33 disposed vertically above the stove body 20 and having an inlet port 331 on a side thereof adjacent to the stove body 20, an outlet port 332 on another side, and a passage 333 having a first and second end respectively communicating with inlet and outlet ports 331 and 332. The heat extracting apparatus 33 has a first side connected to the second shielding member 32 and a second side opposite the first side. The outlet port 332 is located on the second side.

In the operation of the safe combustion device 10, the wick 24 is lit. When the wick 24 is lit, it consumes the fuel 90 in the fuel reservoir 22 and generates a flame and heat.

In view of the forgoing, the fuel tray 23 is disposed above and separately from the fuel reservoir 22, thereby preventing from transferring to the fuel reservoir 22 when the wick 24 is ignited. Moreover, the thermal insulating device 26 prevents the heat from transferring to fuel reservoir 22. Therefore, the fuel 90 in the fuel reservoir 22 is at a relatively low temperature, and a user can operate the safe combustion device 10 more safely.

Furthermore, when the fuel 90 is burned, air adjacent to the wick 24 is heated and rises and creates a current drawing in cold air. Cold air can be admitted through spaces between the first shielding member 31 and the outer container 21 and between the second shielding member 32 and the outer container 21 respectively and flows toward the wick 24. The heated air is disposed near the wick 24 and is away from the first and second shielding members 31 and 32. Therefore, each of the first and second shielding members 31 and 32 is at a relatively low temperature and prevents burning the user inadvertently and damages the material of the wall or the paint thereon.

Furthermore, the heated air is admitted efficiently into the inlet port 331 by the first and second shielding members 31 and 32. The heat air can flow out of the flow guiding device 30 through the outlet port 332 and heats the room air.

The foregoing is merely illustrative of the principles of this invention, and various modifications can be made by those skilled in the art without departing from the scope and spirit of the invention.

What is claimed is:

1. A safe combustion device comprising:

a stove body including a fuel reservoir, a fuel tray disposed vertically above and separately from the fuel reservoir and defining an air flow passage, and a wick with an upper end connected to the fuel tray and disposed in the air flow passage and a lower end disposed in a reservoir space defined by the fuel reservoir respectively, wherein the stove body includes an outer container defining a cavity and the fuel reservoir is disposed in the cavity; and a thermal insulating device interconnecting the fuel reservoir and the fuel tray, wherein the thermal insulating device includes two thermal insulating members and a fixture for supporting the thermal insulating members between the fuel reservoir and the fuel tray, wherein the thermal insulating device has two opposite lateral sides, and wherein the wick extends through the thermal insulating device and is disposed between the two lateral sides thereof, wherein one of the thermal insulating members is abutted against an outer surface of the reservoir and another thermal insulating member is abutted against an outer surface of the fuel tray respectively, wherein the fixture is disposed between the two thermal insulating members, and wherein the fixture includes at least one fixing plate and at least one fastener, wherein the fuel reservoir, the at least one fixing plate, and the fuel tray respectively include an engaging hole for engaging with the at least one fastener, and wherein the at least one fixing plate is disposed between the two thermal insulating members, and one of the two thermal insulating members is secured to the fuel reservoir by engaging the at least one fastener with the engaging holes of the fuel reservoir and the at least one fixing plate while another thermal insulating member is secured to the fuel tray by engaging the at least one fastener with the engaging holes of the fuel tray and the at least one fixing plate.

2. The safe combustion device as claimed in claim 1, wherein the at least one fixing plate includes two fixing plates, and wherein the two fixing plates are disposed adjacent to one another with a space therebetween, and the wick is disposed between the two fixing plates and extends through the space.

3. The safe combustion device as claimed in claim 1, wherein the two thermal insulating members and the at least one fixing plate are in a form of a plate and extend parallel to one another.

4. The safe combustion device as claimed in claim 1, wherein the two fixing plates are made of metal.

5. The safe combustion device as claimed in claim 1, wherein the fuel tray has a fuel drain hole extending therethrough, and the stove body defines a channel having a first and second end respectively communicating with the fuel drain hole and the reservoir space.

6. The safe combustion device as claimed in claim 1, further comprising a flow guiding device, wherein the flow guiding device includes a first and second shielding member respectively disposed adjacent to opposite first and second sides of the outer container, wherein the wick is spaced from the first and second sides at first and second distances respectively, wherein the wick is spaced from the first and second shielding members at third and fourth distances respectively, wherein the third distance is greater than the first distance and the first shielding member is spaced apart from the first side, and wherein the fourth distance is greater than the second distance and the second shielding member is spaced apart from the second side.

7. The safe combustion device as claimed in claim 6, wherein the first shielding member is a glass, and wherein the second shielding member is a glass, or a mount, or a wall of a room.

8. The safe combustion device as claimed in claim 6, wherein the flow guiding device includes a heat extracting apparatus disposed vertically above the stove body, the heat extracting apparatus having an inlet port on a side thereof adjacent to the stove body, an outlet port on another side, and a passage having a first and second end respectively communicating with inlet and outlet ports.

9. The safe combustion device as claimed in claim 7, wherein the heat extracting apparatus has a first side connected to the second shielding member and a second side opposite the first side, and wherein the outlet port is located on the second side.

10. The safe combustion device as claimed in claim 1, wherein outer peripheries of the fuel reservoir are spaced from adjacent inner peripheries of the outer container.

11. The safe combustion device as claimed in claim 1, wherein the wick has a height extending from the upper end to the lower end, and wherein the wick has a greater width at the upper end than the lower end.

12. A safe combustion device comprising:

a stove body including a fuel reservoir, a fuel tray disposed vertically above and separately from the fuel reservoir and defining an air flow passage, and a wick with an upper end connected to the fuel tray and disposed in the air flow passage and a lower end disposed in a reservoir space defined by the fuel reservoir respectively, wherein the stove body includes two shields disposed parallel to one another, wherein the wick is disposed between and spaced from the two shields, wherein the upper end of the wick has a length extending parallel to the shields, wherein each of the two shields includes a top end positioned outside the fuel tray and a bottom end positioned within and spaced from a bottom side of the fuel tray, and wherein the upper end of the wick is at a lower height than the top ends of the shields.

* * * * *